US007609999B2

(12) United States Patent
Gila et al.

(10) Patent No.: US 7,609,999 B2
(45) Date of Patent: Oct. 27, 2009

(54) APPARATUS FOR CHARGING AN IMAGE TRANSFER SURFACE

(75) Inventors: Omer Gila, Cupertino, CA (US); Michael H. Lee, San Jose, CA (US); Seongsik Chang, Santa Clara, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 393 days.

(21) Appl. No.: 11/291,379

(22) Filed: Dec. 1, 2005

(65) Prior Publication Data

US 2007/0127950 A1 Jun. 7, 2007

(51) Int. Cl.
*G03G 15/02* (2006.01)

(52) U.S. Cl. ..... 399/176; 492/53; 492/54; 492/56

(58) Field of Classification Search ..... 399/176; 492/53, 54, 56
See application file for complete search history.

(56) References Cited

U.S. PATENT DOCUMENTS 5,529,842 A * 6/1996 Hoshizaki et al. ..... 428/329
5,659,854 A * 8/1997 Masuda et al. ..... 399/176
6,238,759 B1 5/2001 Meece et al.
6,558,781 B1 * 5/2003 Fuei et al. ..... 428/212
6,771,920 B2 8/2004 Abe et al.
6,942,607 B2 9/2005 Jo et al.
7,330,684 B2 * 2/2008 Okamoto ..... 399/284
2004/0197115 A1 10/2004 Abe et al.

FOREIGN PATENT DOCUMENTS

EP 1400866 A1 3/2004
EP 1403730 A1 3/2004

OTHER PUBLICATIONS

JP 2005 031203 A (Tokai Rubber Ind. Ltd) Feb. 3, 2005; Abstract.
JP 2004 094157 A (Oki Data KK) Mar. 25, 2004; Abstract.
JP 08 106199 A (Tokai Rubber Ind. Ltd.) Apr. 23, 1996; Abstract.
JP 08 015951 A (Tokai Rubber Ind. Ltd) Jan. 19, 1996; Abstract.

* cited by examiner

*Primary Examiner*—David M Gray
*Assistant Examiner*—Bryan P Ready

(57) ABSTRACT

An apparatus for charging an image transfer surface in an image transfer device includes a support member and a conductive polymer material surrounding an outer periphery of the support member. An inner portion of the conductive polymer material is loaded with a supplemental conducting agent, and an outer portion of the conductive polymer material is substantially free of the supplemental conducting agent.

27 Claims, 2 Drawing Sheets

APPARATUS FOR CHARGING AN IMAGE TRANSFER SURFACE

BACKGROUND OF THE INVENTION

The present invention generally relates to image transfer technology and, more particularly, to an apparatus for charging image transfer surfaces of image transfer devices during the printing process, and an image transfer device having the apparatus.

As used herein, the term "image transfer device" generally refers to all types of devices used for creating and/or transferring an image in an electrophotographic process, including laser printers, copiers, facsimiles, and the like. As used herein, the term "electrophotographic process" includes both dry and liquid electrophotographic (LEP) processes.

In an electrophotographic image transfer device, the surface of a photoconducting material (i.e., a photoreceptor) is charged to a substantially uniform potential so as to sensitize the surface. An electrostatic latent image is created on the surface of the charged photoconducting material by selectively exposing areas of the photoconductor surface to a light image of the original document being reproduced. A difference in electrostatic charge density is created between the areas on the photoconductor surface exposed and unexposed to light. For example, in a liquid electrophotographic process, the photoconductor surface is initially charged to approximately −1000 Volts, with the exposed photoconductor surface discharged to approximately −50 Volts. Alternatively, the photoconductor surface can be initially charged to 1000 Volts, with the exposed surface discharged to approximately 50 Volts.

The electrostatic latent image on the photoconductor surface is developed into a visible image using electrostatic toners or pigments. The toners are selectively attracted to the photoconductor surface either exposed or unexposed to light, depending on the relative electrostatic charges of the photoconductor surface, development electrode, and toner. The photoconductor surface may be either positively or negatively charged, and the toner system similarly may contain negatively or positively charged particles.

A sheet of paper or other medium is passed close to the photoconductor surface, which may be in the form of a rotating drum or a continuous belt, transferring the toner from the photoconductor surface onto the paper in the pattern of the image developed on the photoconductor surface. The transfer of the toner may be an electrostatic transfer, as when the sheet has an electric charge opposite that of the toner, or may be a heat transfer, as when a heated transfer roller is used, or a combination of electrostatic and heat transfer. In some printer embodiments, the toner may first be transferred from the photoconductor surface to an intermediate transfer medium, and then from the intermediate transfer medium to a sheet of paper.

Charging of the photoconductor surface may be accomplished by any of several types of charging devices, such as a corotron (a corona wire having a DC voltage and an electrostatic shield), a dicorotron (a glass covered corona wire with AC voltage, and electrostatic shield with DC voltage, and an insulating housing), a scorotron (a corotron with an added biased conducting grid), a discorotron (a dicorotron with an added biased conducting strip), a pin scorotron (a corona pin array housing a high voltage and a biased conducting grid), or a charge roller. In general, charge rollers are used with image transfer devices having slower throughput, while corotrons, scorotons, and the like are used with image transfer devices having faster throughput.

Charge rollers having a variety of designs are known in the art. The elastomeric portion of a charge roller typically assumes one of two configurations. One charge roller configuration is a single-layer elastomer with a moderately conductive material, such as an ionic conduction agent, mixed into the elastomer. The single-layer charge roller may optionally have a very thin (on the order of a few microns) layer of insulating material on its exterior surface. The other charge roller configuration is a double-layer construction having a thicker (on the order of a hundred microns and greater) insulating outer sleeve and an inner elastomeric region loaded with a network of highly conductive material, such as carbon black. The double-layer charge roller configuration generally charges the photoconductor surface less uniformly due to the difficulty in obtaining a constant thickness and resistivity for the outer insulating sleeve.

The ability to use-charge rollers in high-speed high quality image transfer devices is limited by several factors. In particular, currently available charge rollers are unable to provide the required charging voltages at the necessary current frequencies while having a satisfactory lifespan. There is a need for a charge roller capable of use in high-speed high quality image transfer devices.

SUMMARY OF THE INVENTION

The invention described herein provides an apparatus for charging an image transfer surface in an image transfer device. In one embodiment, the apparatus, comprises a support member and a conductive polymer material surrounding an outer periphery of the support member. An inner portion of the conductive polymer material is loaded with a supplemental conducting agent, and an outer portion of the conductive polymer material is substantially free of the supplemental conducting agent.

DESCRIPTION OF THE PREFERRED EMBODIMENTS

In the following detailed description of the preferred embodiments, reference is made to the accompanying drawings which form a part hereof, and in which is shown by way of illustration specific embodiments in which the invention may be practiced. It is to be understood that other embodiments may be utilized and structural or logical changes may be made without departing from the scope of the present invention. The following detailed description, therefore, is not to be taken in a limiting sense, and the scope of the present invention is defined by the appended claims.

Figure 1:
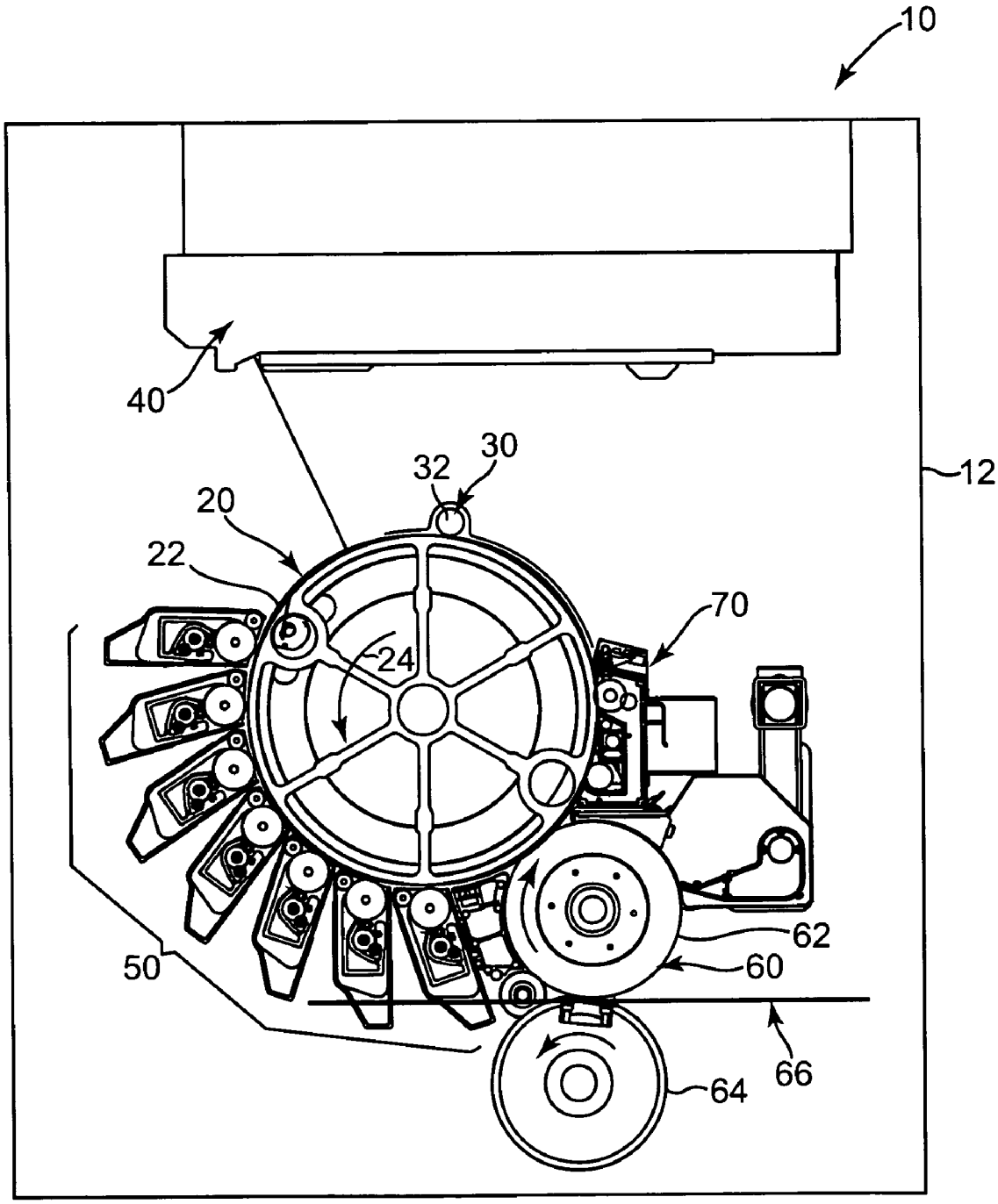
FIG. 1 is a schematic view of an exemplary image transfer device, showing a liquid electrophotographic printer for use with a charging apparatus according to one embodiment of the invention.

An exemplary image transfer device having an image transfer surface, specifically a liquid electrophotographic (LEP) printer 10 having a photoconductor surface 22, is schematically shown in FIG. 1. Although, for purpose of clarity, embodiments according to the invention are illustrated and described herein with respect to an LEP printer having a photoconductor surface, the invention is understood to be applicable and useful with other embodiments of image transfer surfaces and image transfer devices, including image transfer devices utilizing dry electrophotographic processes.

As illustrated, the LEP printer 10 includes a printer housing 12 having installed therein a photoconductor drum 20 having the photoconductor surface 22. Photoconductor drum 20 is rotatably mounted within printer housing 12 and rotates in the direction of arrow 24. Several additional printer components surround the photoconductor drum 20, including a charging apparatus 30, an exposure device 40, a development 50, an image transfer apparatus 60, and a cleaning apparatus 70.

The charging apparatus 30 charges the photoconductor surface 22 on the drum 20 to a predetermined electric potential (typically −500 to −1000 V or 500 to 1000 V). In some embodiments, more than one charging apparatus 30 is provided adjacent the photo conductor surface 22 for incrementally increasing the electric potential of the surface 22. In other embodiments, only a single charging apparatus 30 is provided. The number of charging apparatuses 30 will be affected by factors including the process speed of surface 22 and the desired electric potential of the surface 22. An embodiment of a charging apparatus 30 according to the invention is described in further detail below, with reference to FIG. 2.

The exposure device 40 forms an electrostatic latent image on the photoconductor surface 22 by scanning a light beam (such as a laser) according to the image to be printed onto the photoconductor surface 22. The electrostatic latent image is due to a difference in the surface potential between the exposed and unexposed portion of the photoconductor surface 22. The exposure device 40 exposes images on photoconductor surface 22 corresponding to various colors, for example, yellow (Y), magenta (M), cyan (C) and black (K), respectively.

The development device 50 supplies development liquid, which is a mixture of solid electrostatic toners or pigments dispersed in a carrier liquid (such as Isopar) serving as a solvent (referred to herein as "imaging oil"), to the photoconductor surface 22 to adhere the toner to the portion of the photoconductor surface 22 where the electrostatic latent image is formed, thereby forming a visible toner image on the photo conductor surface 22. The development device 50 may supply various colors of toner corresponding to the color images exposed by the exposure device 40. The carrier liquid is typically electrically insulative.

The image transfer apparatus 60 includes an intermediate transfer drum 62 in contact with the photoconductor surface 22, and a fixation or impression drum 64 in contact with the transfer drum 62. As the transfer drum 62 is brought into contact with the photoconductor surface 22, the image is transferred from the photoconductor surface 22 to the transfer drum 62. A printing sheet 66 is fed between the transfer drum 62 and the impression drum 64 to transfer the image from the transfer drum 62 to the printing sheet 66. The impression drum 64 fuses the toner image to the printing sheet 66 by the application of heat and pressure.

The cleaning apparatus 70 cleans the photoconductor surface 22 of some of the residual material using a cleaning fluid before the photoconductor surface 22 is used for printing subsequent images. In one embodiment according to the invention, the cleaning fluid is imaging oil as used by the development device 50. As the photoconductor surface 22 moves past the cleaning apparatus 70, a submicron layer of oil having residual material therein remains on the photoconductor surface 22.

Although not shown in FIG. 1, the liquid electrophotographic printer 10 further includes a printing sheet feeding device for supplying printing sheets 66 to image transfer apparatus 60, and a printing sheet ejection device for ejecting printed sheets from the printer 10.

Figure 2:
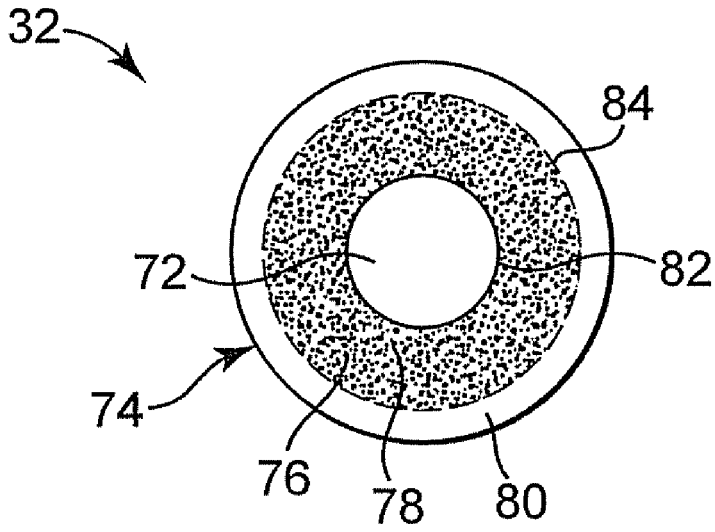
FIG. 2 is a schematic cross-sectional view of a charge roller according to one embodiment of the invention.

Referring now to FIG. 2, the charging apparatus 30 includes a charge roller 32. Charge roller 32 consists of a conductive support member 72 with a conductive polymer material 74 surrounding the conductive support member 72. Conductive support member 72 is typically a metal shaft (such as iron, copper, stainless steels, etc.), but may alternately be formed from carbon-dispersed resins, metal-dispersed resins, or metal-oxide-dispersed resins, for example. During normal printing operation, charge roller 32 is either touching, and a loading force is applied to the charge roller 32 such that the charge roller 32 is compressed against photoconductor surface 22. When charging of photoconductor surface 22 begins, the photoconductor surface 22 is at an electric potential lower than the desired potential. As the photoconductor surface 22 moves into close proximity and/or makes contact with charge roller 32, the photoconductor surface 22 becomes charged.

Voltage is supplied to charge roller 32 in any of various ways known in the art. The voltage may result from a DC source, an AC source, or a DC and AC source. The charge roller 32 is biased by the voltage source to a predetermined electric potential sufficient to create the desired potential on the photoconductor surface 22, for example approximately −1500 to −1000 Volts. If a DC voltage is used alone, the shaft voltage is commonly approximately 540 V higher than the desired photoconductor surface voltage. When an additional AC voltage is supplied, the DC bias is usually close to the desired photoconductor surface voltage with an AC amplitude of 540 V peak or more. The addition of AC voltage usually creates a more uniform charge layer on the photoconductor surface 22 by adding to or subtracting from the charge on the photoconductor surface 22 as needed.

As described above, it is known that the polymer material surrounding the conductive support member of the charge roller may have ionic conductivity (such as by adding a salt as a conducting agent) and may additionally, or alternately, have electronic conductivity (such as by adding carbon black, conductive metal oxides, metal powder or the like as a conducting agent). In general, the conduction mechanism of a charge roller having an ionic conduction agent loaded into the polymer is that of ions moving in response to the application of an electric field. If a layer of the polymeric material is sandwiched between two electrodes and a voltage applied, a current flows, although it generally falls with time. This is consistent with ions moving and piling up on one side of the material layer and leaving behind a charged layer of the opposite sign on the other side, which decreases the electric field available for moving current within the layer between the electrodes. Some charge injection may also occur at the electrodes, which could neutralize some of the ions.

The charge roller must have a sufficiently fast response time to deliver a charge to the photoconductor surface and return to its initial charged state before again approaching the photoconductor surface. If the response time is too slow, a noticeable voltage drop occurs between the conductive support member and the surface of the charge roller, thereby decreasing the photoconductor surface charge. The response time requirement is more stringent when running a charge roller in AC mode at high speeds (in the range of 1 m/s and faster). At high speeds, an AC frequency of at least 6 KHz is needed to maintain a smooth and even photoconductor surface charge, such that the surface charge is free of periodic "ripples."

The AC voltage on the charge roller surface is determined from a voltage divider network of the charge roller and the photoconductor. At low frequency, there is a negligible AC voltage drop across the charge roller due to high photoconductor impedance (a capacitor of approximately 1 nF). However, at higher frequencies, a non-negligible AC voltage drop appears across the charge roller because the photoconductor impedance decreases as frequency increases. A frequency of importance is the RC transition frequency $f_{RC}=1/(2\pi R_{CR}C_{PIP})$, where RCR is the charge roller resistance and $C_{PIP}$ is the photo imaging plate (i.e., photoconductor) capacitance. As can be seen from the equation, a lower charge roller resistance $R_{CR}$ results in a higher transition frequency, $f_{RC}$. A typical polymer formulation with electrical resistivity of $1\times10^7$ Ω·cm has an RC transition frequency $f_{RC}$ of approximately 1 kHz and the AC voltage at the charge roller surface is significantly less than that applied to the core.

The RC transition frequency $f_{RC}$ can be increased by adding additional ionic conduction agents to the polymer material (resulting in a lower charge roller resistance $R_{CR}$). However, commonly used polymer formulations loaded with ionic conduction agents suffer from electrical aging after as few as 8000 machine impressions (about 2% of the desired lifetime). As a result, the charging voltage provided by the charge roller can drop by several hundred volts due to a resistance increase caused by charge depletion from the loaded polymer material. With or without a large voltage drop, this charge migration may also induce chemical failure of the charge roller when its polymer bonds break, which at times causes liquids to emanate from the roller surface. A higher concentration of ionic conduction agents will only speed chemical failure of the polymer material. Thus, the benefits of the increased RC transition frequency $f_{RC}$ are offset by the decreased lifespan of the charge roller.

One way to enhance the polymer conductivity without increasing the ion concentration is to load carbon black (or other suitable electronic conduction agent) into the polymer in a very low percentage. The combination of an electronic conduction agent and an ionic conduction agent harnesses both ionic and electronic conductivity, and increases the AC response of the material by increasing $f_{RC}$. Although the electronic conduction agent may not enhance roller DC conductivity at the lowest percentage, its still increases the AC response due to the material's high dielectric constant. As the concentration of the electronic conduction agent concentration increases, however, the electronic conduction agents create high field lines due to their capability of aggregating charge at the ends of conductive chains which initiates sparking when close to the surface of the charge roller. Also, the electronic conduction agents allow the high current flows needed to create breakdown and sparking. Thus, the addition of carbon black or other suitable conduction agent increases the likelihood that the charge roller will occasionally spark through the photoconductor and create a pinhole, which kills the photoconductor at that location. Sparking is more likely to happen, for example, when the charge roller is exposed to high humidity conditions that increase its conductivity or when the photoconductor has weak spots.

As described above, previous solutions to eliminate sparking rely on providing a relatively thick, low conductivity outer layer on the charge roller. However, the low conductivity outer layer reduces the charge roller performance by enhancing electrical aging and producing less uniform charging. Typically available charge rollers of this design have a lifespan of around 20,000 impressions, as compared to the desired 400,000 to 500,000 impressions.

Referring again to FIG. 2, to prevent sparking while maintaining satisfactory high frequency performance, the conductive polymer material 74 of charge roller 32 includes an inner portion 76 loaded with a supplemental conducting agent 78, while the outer portion 80 of the conducive polymer material 74 is substantially or completely free of the supplemental conducting agent 78. In one embodiment, the outer portion 80 has a thickness in the range of approximately 10 μm to 400 μm (the relative dimensions of the Figures are greatly distorted for purposes of clarity). The conductive polymer material 74 of charge roller 32 may be an inherently electrically conductive polymer (such as nitrile rubber and polyepichlorodrin), or may be an inherently electrically insulative polymer loaded with a conducting agent different than the supplemental conducting agent. The boundary between inherently conductive and inherently insulating depends on the process speed of the image transfer device. To be inherently conductive, the material must have adequate response at the operating speed in the absence of dopants.

In one embodiment, the conductive polymer material 74 of charge roller 32 is an inherently electrically insulative elastomer loaded with a suitable ionic conduction agent, and having an electronic conduction agent as the supplemental conducting agent 78. Suitable elastomers include, but are not limited to materials such as chloroprene rubber, isoprene rubber, EPDM rubber, polyurethane rubber, epoxy rubber, butyl rubber, to name a few. A preferred insulative elastomer is polyurethane. Suitable ionic conduction agents include, but are not limited to, salts. A preferred ionic conduction agent is lithium salt. Suitable electronic conduction agents include, but are not limited to, carbon black, conductive metal oxides and metal powders. A preferred electronic conduction agent 78 is carbon black loaded to a concentration in the range of 0.01 to 0.5% by weight.

In one embodiment, the resistivity of the inner portion 76 is approximately the same as a resistivity of the outer portion 80. The resistivity values of the inner portion 76 and outer portion 80 can be approximately equalized by loading the outer portion 80 with a higher concentration of the ionic conduction agent to compensate for the presence of the electronic conduction agent 78 in the inner portion 76. In one embodiment, the conductive polymer material 74 has a volume resistivity in the range of about $10^5$ to $10^8$ ohm-centimeters prior to loading the supplemental conducting agent 78, and a volume resistivity in the range of $10^4$ to $10^8$ ohm-centimeters after the supplemental conducting agent 78 has been added.

Figure 3:
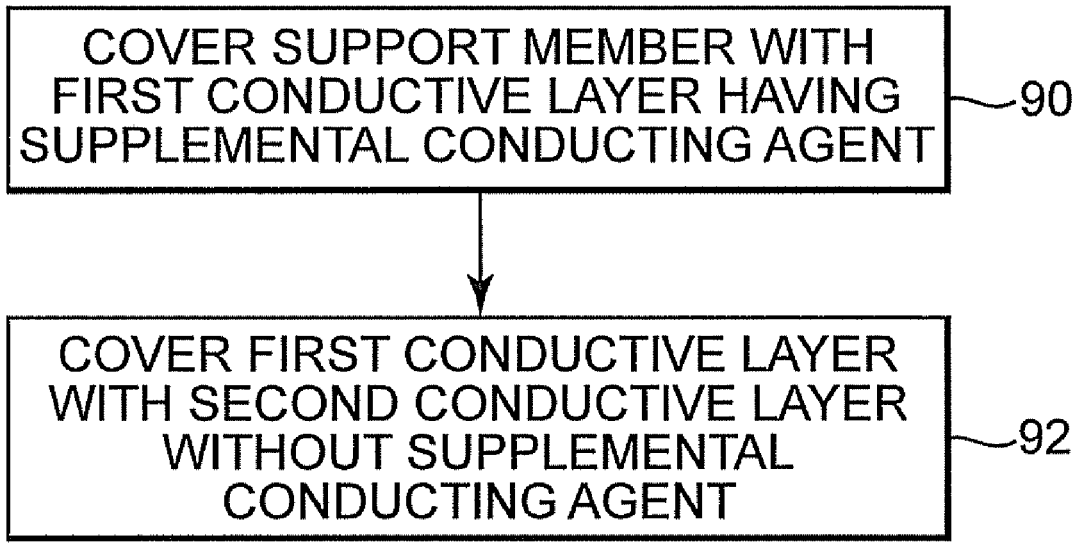
FIG. 3 is a flow chart illustrating one embodiment of a method of making a charge roller.

Referring to FIG. 3, in one embodiment, the charge roller 32 is formed by covering the outer periphery 82 of the conductive support member 72 with a first layer of material (operation 90), where the first layer of material comprises a conductive polymer with a supplemental a conducting agent loaded into the conductive polymer. The first layer of material will form the inner portion 76 of the completed charge roller 32. The outer periphery 84 of the first layer is then covered with a second conductive layer (operation 92). The second layer of material will form the outer portion 80 of the completed charge roller 32. The second conductive layer comprises substantially the same conductive polymer of the first layer, absent the supplemental conducting agent. As described above, in some embodiments the material of the second layer (i.e., the outer portion 80 of charge roller 32) will have a higher concentration of ionic conduction agent than the material of the first layer (i.e., the inner portion of charge roller 32), such that the first and, second layers (i.e., the inner and outer portions 76, 80) have substantially the same resistivity.

The first and second layers may be formed by any suitable means known in the art, and may be, for example, molded, cast, or machined. In one embodiment, the second layer is formed by spraying the material of the second layer onto the first layer. In another embodiment, the second layer is formed by dip coating the first layer with the material of the second layer. In some instances, to achieve the desired thickness of the second layer, it may be necessary to apply the material of the second layer more than one time.

The charge roller 32 as described herein prevents sparking by eliminating the presence of the electronically conductive supplemental conducting agent (carbon chains in a preferred embodiment) from the surface of the charge roller 32. Adding an outer layer of conductive polymer without the supplemental conducting agent, even with high conductivity, dramatically reduces the likelihood of breakdowns and sparking, even with extreme humidity conditions. In addition, the absence of an insulating layer on the outer surface of the charge roller improves the frequency response time and charging uniformity of the charge roller.

EXAMPLE

A liquid electrophotographic (LEP) printer was operated with a charge roller like that illustrated in FIG. 2, and compared to a reference charge roller. The reference charge roller included a 5 mm thick coating of urethane loaded with lithium salt and carbon black to produce a conductive material. The charge roller according to FIG. 2 was similarly constructed, and further included a 50 μ coating of the urethane without carbon black. The charge rollers were placed in a humidity chamber and subjected to constant and extreme humidity conditions (22° C. at 92% humidity) for an extended period of days. The charge rollers were tested daily and checked for sparking, with the results shown in Table 1 below. As can be seen, the inventive charge roller demonstrated a lifespan twice that of the reference charge roller.

TABLE 1

| | Days at 92% Humidity 22° C. | | | | | | | | | | | | | |
|---|---|---|---|---|---|---|---|---|---|---|---|---|---|---|
| | 1 | 2 | 3 | 4 | 5 | 6 | 7 | 8 | 9 | 10 | 11 | 12 | 13 | 14 |
| reference charge roller - 5 mm urethane with no coating | ○ | ○ | ○ | ○ | ○ | X | X | X | X | X | X | X | X | X |
| new charge roller - 5 mm urethane + Carbon with 50μ of non-carbon urethane | ○ | ○ | ○ | ○ | ○ | ○ | ○ | ○ | ○ | ○ | X | X | X | X |

X - spark (photoconductor damaged)
○ - no sparks

Although specific embodiments have been illustrated and described herein for purposes of description of the preferred embodiment, it will be appreciated by those of ordinary skill in the art that a wide variety of alternate and/or equivalent implementations may be substituted for the specific embodiments shown and described without departing from the scope of the present invention. Those with skill in the mechanical, electro-mechanical, and electrical arts will readily appreciate that the present invention may be implemented in a very wide variety of embodiments. This application is intended to cover any adaptations or variations of the preferred embodiments discussed herein. Therefore, it is manifestly intended that this invention be limited only by the claims and the equivalents thereof.

What is claimed is:

1. An apparatus for contact charging an image transfer surface in an image transfer device, comprising:

a support member; and a conductive polymer material surrounding an outer periphery of the support member, wherein an inner portion of the conductive polymer material is loaded with a supplemental conducting agent and an outer portion of the conductive polymer material is substantially free of the supplemental conducting agent, wherein the conductive polymer material includes an ionic conduction agent and the supplemental conducting agent includes an electronic conduction agent such that the inner portion of the conductive polymer material includes the ionic conduction agent and the electronic conduction agent, and the outer portion of the conductive polymer material includes the ionic conduction agent and is substantially free of the electronic conduction agent.

2. The apparatus of claim 1, wherein the conductive polymer material comprises an inherently insulative polymer material loaded with a first conducting agent.

3. The apparatus of claim 2, wherein the first conducting agent comprises the ionic conduction agent.

4. The apparatus of claim 3, wherein the ionic conduction agent comprises a salt.

5. The apparatus of claim 3, wherein the electronic conduction agent comprises at least one of carbon black, conductive metal oxide and metal powder.

6. The apparatus of claim 1, wherein a resistivity of the inner portion is approximately the same as a resistivity of the outer portion.

7. The apparatus of claim 6, wherein the inner portion of the conductive polymer is loaded with a first concentration of a first conducting agent and the outer portion of the conductive polymer is loaded with a second concentration of the first conducting agent.

8. The apparatus of claim 7, wherein the first concentration of the first conducting agent in the inner portion of the conducting polymer is less than the second concentration of the first conducting agent in the outer portion of the conducting polymer.

9. The apparatus of claim 1, wherein the supplemental conducting agent is carbon black.

10. The apparatus of claim 9, wherein the inner portion of the conductive polymer material comprises in the range of 0.01 to 0.5% by weight carbon black.

11. The apparatus of claim 1, wherein the conductive polymer material has a volume resistivity in the range of about $10^5$ to $10^8$ ohm-centimeters prior to loading the supplemental conducting agent.

12. The apparatus of claim 11, wherein the conductive polymer material loaded with the supplemental conducting agent has a volume resistivity in the range of $10^4$ to $10^8$ ohm-centimeters.

13. The apparatus of claim 1, wherein the outer portion of the conductive polymer material has a thickness in the range of approximately 10 μm to 400 μm.

14. The apparatus of claim 1, wherein the conductive polymer material is comprises ion-conductive material.

15. The apparatus of claim 14, wherein the ion-conductive material comprises polyurethane loaded with lithium salt.

16. The apparatus of claim 1, wherein the support member comprises a metal rod.

17. An electrophotographic device comprising:

a photoconductor surface for creating an image thereon; and a charge roller for electrically charging the photoconductor surface, the charge roller having an inner conductive layer comprising a conductive polymer material loaded with a supplemental conducting agent and an outer conductive layer comprising the conductive polymer material substantially free of the supplemental conducting agent, wherein the conductive polymer material includes an ionically conductive material and the supplemental conducting agent includes an electronic conduction agent such that the inner conductive layer includes the ionically conductive material and the electronic conduction agent, and the outer conductive layer includes the ionically conductive material and is substantially free of the electronic conduction agent.

18. The electrophotographic device of claim 17, wherein the supplemental conducting agent is carbon black.

19. The electrophotographic device of claim 17, wherein the ionically conductive material is lithium salt.

20. The electrophotographic device of claim 17, wherein the inner conductive layer has a volume resistivity in the range of $10^4$ to $10^8$ ohm-centimeters.

21. The electrophotographic device of claim 17, wherein the outer conductive layer has a volume resistivity in the range of $15^5$ to $10^8$ ohm-centimeters.

22. The electrophotographic device of claim 17, wherein the outer conductive layer has a thickness in the range of approximately 10-400 μm.

23. The electrophotographic device of claim 17, further comprising:

an exposure device for forming a latent image on the photoconductor surface;

a development device for developing the latent image on the photoconductor surface; and an image transfer apparatus for transferring the image from the photo conductor surface to a printing sheet.

24. The electrophotographic device of claim 17, wherein the photoconductor surface is a continuous surface.

25. A method of making a charge roller for charging an image transfer surface in an image transfer device, the method comprising:

covering an outer periphery of a support member with a first conductive layer, the first conductive layer comprising a conductive polymer and a supplemental conducting agent mixed in the conductive polymer; and covering an outer periphery of the first conductive layer with a second conductive layer, the second conductive layer comprising the conductive polymer, wherein the conductive polymer includes an ionically conductive material and the supplemental conducting agent includes an electronic conduction agent such that the first conductive layer includes the ionically conductive material and the electronic conduction agent, and the second conductive layer includes the ionically conductive material and is substantially free of the electronic conduction agent.

26. The method of claim 25, wherein covering an outer periphery of the first conducive layer with a second conductive layer comprises spray coating the first conductive layer with the conductive polymer.

27. The method of 25, wherein covering an outer periphery of the first conducive layer with a second conductive layer comprises dip coating the first conductive layer with the conductive polymer.

* * * * *

UNITED STATES PATENT AND TRADEMARK OFFICE

CERTIFICATE OF CORRECTION

PATENT NO. : 7,609,999 B2
APPLICATION NO. : 11/291379
DATED : October 27, 2009
INVENTOR(S) : Omer Gila et al.

It is certified that error appears in the above-identified patent and that said Letters Patent is hereby corrected as shown below:

In column 3, line 10, after "development" insert -- device --.

In column 6, line 5, delete "conducive" and insert -- conductive --, therefor.

In column 9, line 9, in Claim 14, after "material" delete "is".

In column 9, line 41, in Claim 22, delete "$15^5$" and insert -- $10^5$ --, therefor.

In column 10, line 11, in Claim 23, delete "photo conductor" and insert -- photoconductor --, therefor.

In column 10, line 33, in Claim 26, delete "conducive" and insert -- conductive --, therefor.

In column 10, line 36, in Claim 27, delete "of" and insert -- of claim --, therefor.

In column 10, line 37, in Claim 27, delete "conducive" and insert -- conductive --, therefor.

Signed and Sealed this

Thirteenth Day of April, 2010

David J. Kappos

David J. Kappos
*Director of the United States Patent and Trademark Office*